United States Patent [19]

Nowakowski

[11] Patent Number: 4,813,465

[45] Date of Patent: Mar. 21, 1989

[54] WOOD FINGERJOINT BLOCK TRIM REDUCTION PROCESS

[76] Inventor: Karol Nowakowski, 1473 NW. Quincy, Bend, Oreg. 97701

[21] Appl. No.: 31,880

[22] Filed: Mar. 30, 1987

[51] Int. Cl.[4] ..... B27B 1/00

[52] U.S. Cl. ..... 144/357; 83/367

[58] Field of Search ..... 209/517, 518, 521, 587; 144/357; 83/367

[56] References Cited

U.S. PATENT DOCUMENTS 4,195,346 3/1980 Schroder ..... 144/357

4,325,421 4/1982 Janovick et al. ..... 144/357

*Primary Examiner*—W. Donald Bray

*Attorney, Agent, or Firm*—Klarquist, Sparkman, Campbell, Leigh & Whinston

[57] ABSTRACT

The invention provides a trim waste reduction process for wood fingerjointing operations. It normally includes the following steps: (1) Automatic determination if the end profile of each block is acceptable with less or no trim (2) Displacing acceptable wood blocks from path of trim saw as desired.

8 Claims, 1 Drawing Sheet

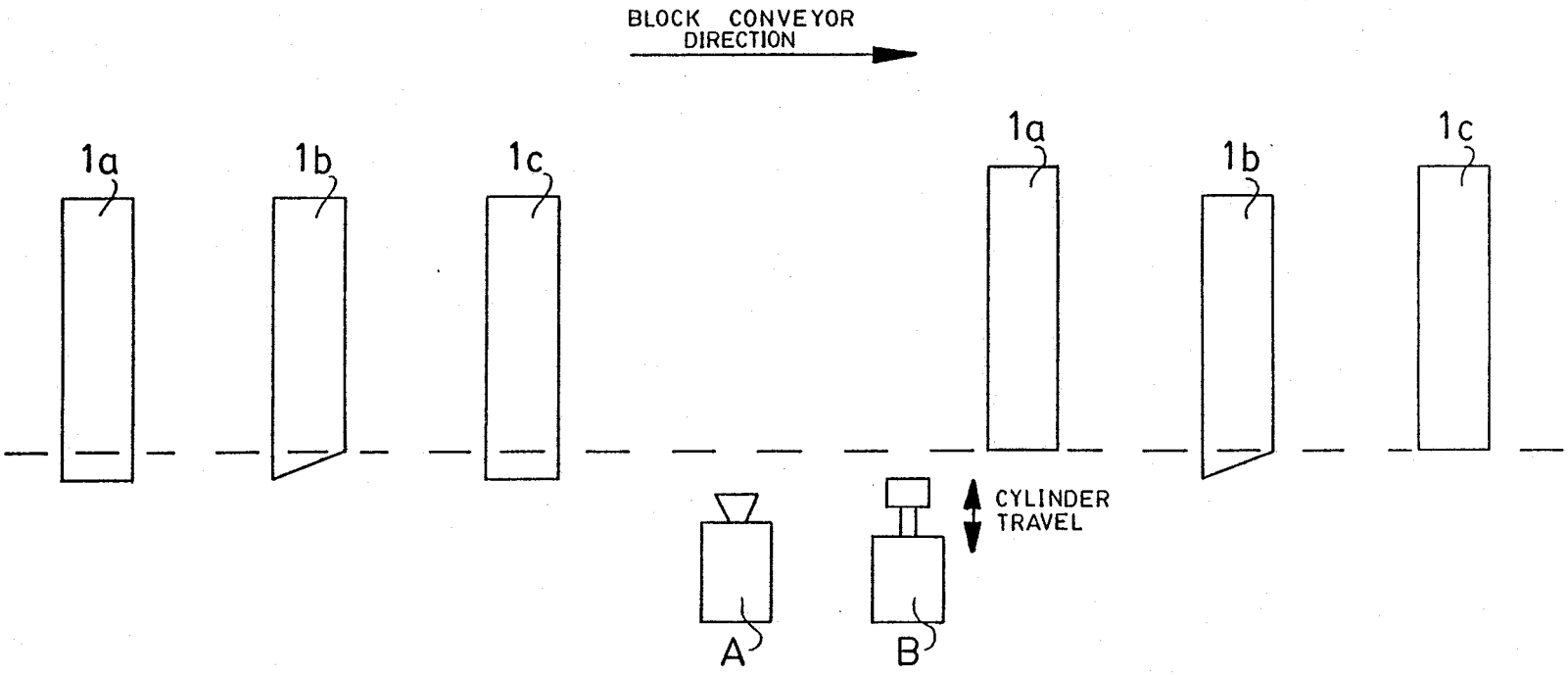
BLOCK CONVEYOR DIRECTION
1a
1b
1c
1a
1b
1c
A
B
CYLINDER TRAVEL

WOOD FINGERJOINT BLOCK TRIM REDUCTION PROCESS

BACKGROUND OF THE INVENTION

1. Field of the Invention

This invention relates to a waste reduction process for wood fingerjointing operations.

2. Description of Prior Art

In many wood processing operations pieces of wood are generated which are too short for direct use as an end product. These short blocks are processed in such a way that as a result they are glued together end to end to make long pieces which may find use as a valuable product. This operation involves several processes and are collectively referred to as fingerjointing in the industry.

One of the activities in fingerjointing is to ensure each short block of wood has acceptably square ends prior to gluing end to end. As each block of wood moves down a conveyor they come into contact with a fixed mechanical fence which is angled to cause each block to shift position for alignment to a trim saw which trims the end of the block assuring an acceptably square end. In the process of setting and locking the fence position to fix the amount of trim taken on each block, the operator wants to minimize the frequency of having to deal with blocks that are so far out of square that the trim taken was insufficient to create a square end. As a result industry practice is to take a predetermined amount of trim off all blocks of wood even though only a very few blocks are actually out of square and need the full trim taken.

Considering the value of timber as both a commercial product and a natural resource, it is the objective of the present invention to provide a process for fingerjointing wood for which there really is no focused prior art. Specifically, the present invention has as its objective the following: To provide a new trim reduction process which reduces unnecessary trim on individual wood blocks to be used for fingerjointing thereby increasing profits and/or lowering prices, while at the same time conserving a valuable natural resource.

SUMMARY OF THE INVENTION

The invention relates to material waste in prior art by providing a process for fingerjointing trim reduction. The process includes the following steps: (1) automatic determination if end profile of each block is acceptable with less or no trim; (2) displacing acceptable blocks from the path of trim saw as desired.

The first step of automatic determination of suitability of block end profile is performed after each block has been aligned to a traditional fixed mechanical fence and prior to the end trim saw. The second step of automatically displacing each block on an individual basis relative to the fixed trim saw occurs after the first step and prior to the end trim saw.

DETAILED DESCRIPTION OF THE PREFERRED EMBODIMENT

The present invention is schematically depicted in FIG. 1. The schematic depiction includes three pieces of wood 1*a*, 1*b*, and 1*c* shown before and after alignment for cutting. A sensor mechanism which determines acceptability is identified as A. A displacement mechanism which relocates acceptable pieces to avoid excessive trim is labeled as B. The dashed line represents the alignment or cutting plane of the trim saw blade. In the drawing, pieces 1*a*, 1*b*, and 1*c* are indicated as being initially positioned to encounter the saw blade as they move downstream.

An operator calibrates his/her sensor A setup to accept or and reject blocks of wood per end product specifications desired. Likewise, the operator calibrates the displacement mechanism B to move acceptable blocks out of the path of the trim saw downstream by a distance suitable to end product specifications. In FIG. 1, block 1*b* is depicted as not square. As blocks 1*a*, 1*b*, and 1*c* approach the sensor, the sensor determines that blocks 1*a* and 1*c* are acceptably square. Blocks 1*a* and 1*c* are pushed out of the trim saw path by the displacement mechanism B thereby avoiding unnecessary trim. Block 1*b* which was determined not to be square by sensor A is ignored by displacement mechanism B thereby being end trimmed as it moves downstream.

TYPICAL MECHANISMS USED TO PRACTICE PROCESS EMBODIMENT

In the discussion above the sensor step A was looking at the end profile of each block of wood for squareness. In virtually all variations of this step A, standard industrial proximity sensors may be employed for determination of a block's surface distance from the sensor. The displacement mechanism B would typically be an air operated cylinder with known variable stroke length which would displace pieces such as 1*a* and 1*c* by the reqiured distance every time.

Of course, it should be understood that various changes and modifications of the mechanisms used to practice the process embodiment herein will be apparent to those skilled in the art. Such changes and modifications can be made without departing from the spirit and scope of the present invention and without diminishing its attendant advantages. It is, therefore, intended that such changes and modifications be covered by the following claims.

I claim:

1. A process for facing the ends of wood pieces which are to be joined together end-to-end by finger joining, the process comprising:

successively moving the pieces of wood toward a saw blade with an elongated surface of each piece oriented transversely to the saw blade and parallel to elongated surfaces of the other pieces;

aligning the pieces so that one end of each piece moves along a path parallel to the saw blade;

passing the one end of each piece by a sensor mechanism as the pieces move toward the saw blade;

scanning the one end of each piece with the sensor mechanism, as the one end passes thereby, to determine whether the one end extends substantially parallel to the saw blade, the sensor mechanism providing a control signal depending on whether the end is sensed as being substantially parallel without regard to the length of piece; and transmitting the signal to a displacement mechanism located to engage the wood pieces that are moving from the sensor mechanism towards the saw blade, which displacement mechanism selectively moves the scanned pieces transversely with respect to the cutting plane of the saw blade in response to corresponding signals such that, automatically and regardless of the lengths of the pieces, (a) each piece which has a substantially parallel one end is positioned to avoid being cut by the saw blade whereby unnecessary trim is avoided, and (b) each piece which does not have a substantially parallel one end is positioned so that a small portion at the one end of that piece is cut off as that piece passes the saw blade, thereby producing a substantially square end without unnecessary trim being taken.

2. The process of claim 1 wherein the displacement mechanism is an air operated cylinder that moves responsively to the sensor mechanism.

3. The process of claim 3 further comprising:

initially aligning all of the pieces so as to be cut by the saw blade as the pieces move along the path; and then operating the displacement mechanism to move selected pieces out of cutting alignment with the saw blade to avoid unnecessary cutting of the moved pieces.

4. The process of claim 1 wherein the sensor mechanism is a proximity sensor.

5. An apparatus for reducing trim waste which occurs when facing the ends of wood pieces which are to be joined end-to-end by finger jointing, the apparatus comprising:

a conveyor mechanism for moving the pieces toward a saw blade with (a) the pieces in parallel alignment with one another, (b) the pieces in transverse alignment with respect to the saw blade, and (c) one end of each piece located in a path parallel to the saw blade as the pieces are moved by the conveyor mechanism;

a sensor mechanism for scanning the ends to determine whether each end extends parallel to the path without regard to the length of the piece being scanned; and a displacement mechanism, responsive to the sensor mechanism, which displacement mechanism selectively moves certain pieces transversely with respect to the cutting plane of the saw blade such that (a) if a piece has a one end substantially parallel to the path, that piece is positioned to avoid being cut by the saw blade whereby unnecessary trim is avoided, and (b) if a piece has a one end that is not substantially parallel to the path, that piece is positioned so that the saw cuts off a small portion at the one end, thereby producing a substantially square end without unnecessary trim being taken.

6. The apparatus of claim 5 wherein the displacement mechanism is an air operated cylinder.

7. The apparatus of claim 5 wherein:

the alignment means is adapted to initially align all of the pieces to be cut off at their one ends; and the displacement mechanism is adapted to subsequently push selected pieces out of cutting alignment with the saw blade.

8. The apparatus of claim 5 wherein the sensor mechanism is a proximity sensor.

* * * * *